US008592023B2

(12) United States Patent
Es Van et al.

(10) Patent No.: US 8,592,023 B2
(45) Date of Patent: Nov. 26, 2013

(54) BALLISTIC RESISTANT SHEET AND BALLISTIC RESISTANT ARTICLE

(75) Inventors: Martin Antonius M. A. Es Van, Brunssum (NL); Marcel M. Jongedijk, Sittard (NL); Roelof R. Marissen, Koningstraat (NL); Hen H. Hoefnagels, Ravensboschstraat (NL)

(73) Assignee: DSM IP Assets B.V., Heerlen (NL)

( * ) Notice: Subject to any disclaimer, the term of this patent is extended or adjusted under 35 U.S.C. 154(b) by 576 days.

(21) Appl. No.: 12/520,711

(22) PCT Filed: Dec. 21, 2007

(86) PCT No.: PCT/EP2007/011324

§ 371 (c)(1), (2), (4) Date: Nov. 6, 2009

(87) PCT Pub. No.: WO2008/077605

PCT Pub. Date: Jul. 3, 2008

(65) Prior Publication Data

US 2010/0064404 A1 Mar. 18, 2010

Related U.S. Application Data

(60) Provisional application No. 60/876,543, filed on Dec. 22, 2006.

(30) Foreign Application Priority Data

Dec. 22, 2006 (EP) ..... 06026726

(51) Int. Cl.
*F41H 1/02* (2006.01)
*B32B 5/12* (2006.01)

(52) U.S. Cl.
USPC ..... 428/105; 139/383 R; 428/107; 428/156; 428/213; 428/364; 429/144

(58) Field of Classification Search
USPC ..... 428/105, 107, 156, 213, 364; 139/383 R; 429/144
See application file for complete search history.

(56) References Cited

FOREIGN PATENT DOCUMENTS

| | | | |
|---|---|---|---|
| EP | 0 907 504 | 12/2002 | |
| EP | 1 627 719 | 2/2006 | |
| EP | 1 724 097 | 11/2006 | |
| WO | 00/29468 | 5/2000 | |
| WO | 2005/066401 | 7/2005 | |
| WO | WO 2005066577 A1 * | 7/2005 | ..... F41H 5/04 |
| WO | 2006/002977 | 1/2006 | |

OTHER PUBLICATIONS

International Search Report for PCT/EP2007/011324, mailed Apr. 4, 2008.

* cited by examiner

*Primary Examiner* — Brent O'Hern
(74) *Attorney, Agent, or Firm* — Nixon & Vanderhye P.C.

(57) ABSTRACT

Ballistic resistant sheets and molded articles formed thereof are disclosed, wherein a ballistic resistant sheet includes a stack of at least 4 monolayers, each monolayer containing unidirectionally oriented reinforcing fibers with a tensile strength of between 3.5 and 4.5 GPa, and at most 20 mass % of a matrix material, the areal density of a monolayer is at least 25 g/m$^2$ and with the fiber direction in each monolayer being rotated with respect to the fiber direction in an adjacent monolayer. When a plurality of the ballistic resistant sheets are formed into a pile and subjected to curved molding conditions, a homogenous curved ballistic resistant molded article is formed without irregular folding of the ballistic resistant sheets in the pile.

11 Claims, No Drawings

BALLISTIC RESISTANT SHEET AND BALLISTIC RESISTANT ARTICLE

This application is the U.S. national phase of International Application No. PCT/EP2007/011324, filed 21 Dec. 2007, which designated the U.S. and claims priority to Europe Application No. 06026726.7, filed 22 Dec. 2006, and U.S. Application No. 60/876,543, filed 22 Dec. 2006, the entire contents of each of which are hereby incorporated by reference.

FIELD

The present invention relates to a ballistic resistant sheet and a ballistic resistant article.

BACKGROUND AND SUMMARY

A ballistic resistant sheet comprises a stack of at least 4 monolayers, each monolayer containing unidirectionally oriented reinforcing fibers with at most 20 mass % of a matrix material, and with the fiber direction in each monolayer being rotated with respect to the fiber direction in an adjacent monolayer. Such a ballistic resistant sheet is very suitable for use in compressed or moulded ballistic resistant articles such as panels and especially curved panels.

Such a ballistic resistant sheet is known from U.S. Pat. No. 4,623,574. This publication discloses the manufacture of ballistic resistant sheets by cross plying and stacking a plurality of monolayers, each with unidirectionally aligned extended chain polyethylene fibers and a matrix material, followed by pressing them into a sheet. Example 1 of this disclosure mentions the production of a monolayer by helically wrapping polyethylene fibers side-by-side on a drum winder whereby a Kraton D1107 solution was used to coat the unidirectionally aligned fibers. A plurality of the thus obtained monolayers was stacked whereby the fiber direction in a monolayer is perpendicular to the fiber direction in an adjacent monolayer. The obtained stack was put between parallel plates in an Apollo press and pressed with a pressure of 0.6 MPa at a temperature of 130° C. for 5 minutes, followed by cooling.

There is continuous drive towards improved ballistic resistant moulded articles and the present inventors have surprisingly found a ballistic resistant sheet that enables the manufacture of compressed panels or ballistic resistant moulded articles with improved mouldability. Improved mouldability means that upon moulding of a ballistic resistant article, especially a curved ballistic resistant article, comprising several ballistic resistant sheets of the invention a homogeneous product is obtained; this can be judged by the human eye e.g. by absence of an inhomogeneous drape of the ballistic resistant sheets in said article after moulding.

According to the present invention an improved ballistic sheet is provided, comprising a stack of at least 4 monolayers, each monolayer containing unidirectionally oriented reinforcing fibers with a tensile strength of between 3.5 an 4.5 GPa, and at most 20 mass % of a matrix material, the areal density of a monolayer of at least 25 g/m$^2$ and with the fiber direction in each monolayer being rotated with respect to the fiber direction in an adjacent monolayer.

DETAILED DESCRIPTION

The ballistic resistant sheet according to the invention provides good mouldability.

This can be seen upon moulding of a curved ballistic resistant article, comprising several piled up ballistic resistant sheets of the invention where, a homogeneous moulded article is obtained without irregular folding of the ballistic resistant sheets. An additional advantage is that the ballistic resistant sheet according to the invention shows a further improved anti-ballistic performance.

In the present invention the term monolayer refers to a layer of unidirectionally oriented reinforcing fibers and a matrix material that basically holds the fibers together.

A ballistic resistant sheet comprises a stack of at least 4 monolayers, preferably the at least 4 monolayers being linked or attached to one another. The monolayers are stacked in such a way that the fiber direction in each monolayer being rotated with respect to the fiber direction in an adjacent monolayer. The angle of rotation, which means the smallest angle enclosed by the fibers of the adjacent mono-layers, is preferably between 0° and 90°, more preferably between 10° and 80°. Most preferably, the angle is between 45° and 90°.

The fibres in the ballistic resistant sheet of the invention have a tensile strength of between 3.5 and 4.5 GPa. The fibers preferably have a tensile strength of between 3.6 and 4.3 GPa, more preferably between 3.7 and 4.1 GPa or most preferably between 3.75 and 4.0 GPa.

The fibers may be inorganic or organic fibers. Suitable inorganic fibers are, for example, glass fibers, carbon fibers and ceramic fibers.

Suitable organic fibers with such a high tensile strength are, for example, aromatic polyamide fibers (also often referred to as aramid fibers), especially poly(p-phenylene teraphthalamide), liquid crystalline polymer and ladder-like polymer fibers such as polybenzimidazoles or polybenzoxazoles, especially poly(1,4-phenylene-2,6-benzobisoxazole) (PBO), or poly(2,6-diimidazo[4,5-b-4',5'-e]pyridinylene-1,4-(2,5-dihydroxy)phenylene) (PIPD; also referred to as M5) and fibers of, for example, polyolefins, polyvinyl alcohol, and polyacrylonitrile which are highly oriented, such as obtained, for example, by a gel spinning process. Highly oriented polyolefin, aramid, PBO and PIPD fibers, or a combination of at least two thereof are preferably used.

High performance polyethylene fibers or highly drawn polyethylene fibers consisting of polyethylene filaments that have been prepared by a gel spinning process, such as described, for example, in GB 2042414 A or WO 01/73173, are even more preferably used. The advantage of these fibers is that they have very high tensile strength combined with a light weight, so that they are in particular very suitable for use in lightweight ballistic-resistant articles.

Most preferably, use is made of multifilament yarns of ultra-high molar mass linear polyethylene with an intrinsic viscosity of at least 5 dl/g.

The titer of a single filament of these fibers or yarns preferably is at most 2 denier, more preferably the titer of a single filament of these fibers is at most 1.9 denier. This results in a better mouldability of the ballistic resistant moulded article comprising the ballistic resistant sheet. Most preferably the titer of a single filament of these fibers is at most 1.8 denier.

The term matrix material refers to a material that binds or holds the fibers together and may enclose the fibers in their entirety or in part, such that the structure of the mono-layer is retained during handling and making of preformed sheets. The matrix material can be applied in various forms and ways; for example as a film between monolayers of fiber, as a transverse bonding strip between the unidirectionally aligned fibers or as transverse fibers (transverse with respect to the unidirectional fibers), or by impregnating and/or embedding the fibers with a matrix material.

In a preferred embodiment, the matrix material is a polymeric matrix material, and may be a thermosetting material or a thermoplastic material, or mixtures of the two. The elongation at break of the matrix material is preferably greater than the elongation of the fibers. The matrix material preferably has an elongation of 3 to 500%. In another preferred embodiment, the matrix material is a polymeric matrix material preferably has an elongation of at least 200%, more preferably from 300 to 1500%, more preferably from 400 to 1200%. From the group of thermosetting materials, vinyl esters, unsaturated polyesters, epoxies or phenol resins are preferably selected as matrix material. From the group of thermoplastic materials, polyurethanes, polyvinyls, polyacrylics, polyolefins or thermoplastic elastomeric block copolymers such as polyisopropene-polyethylene-butylene-polystyrene or polystyrene-polyisoprene-polystyrene block copolymers are preferably selected as matrix material.

More preferably the matrix material in the process according to the invention has a 100% modulus of at least 3 MPa. This is understood to be a secant modulus measured according to ISO 527 at a strain of 100%.

Particularly suitable are those matrix materials that can be applied as a dispersion in water. Examples of suitable thermoplastic materials include: acrylates, polyurethanes, modified polyolefins and ethylene vinyl acetate. Preferably, the matrix material contains a polyurethane. More preferably, the polyurethane is a polyetherurethane, that is based on a polyetherdiol. This provides good performance over a wide temperature range. In a special embodiment, the polyurethane or polyetherurethane is based on aliphatic diisocyanates as this further improves product performance, especially its colour stability.

Preferably the 100% modulus is at least 5 MPa. The 100% modulus is generally lower than 500 MPa.

The amount of matrix material in the monolayer is at most 20 mass %. This results in a good combination of ballistic performance and mouldability. Preferably the amount of matrix material in the monolayer is at most 18.5 mass %; more preferably at most 17.5 mass %. This results in an even better combination of ballistic performance and mouldability. Most preferably the amount of matrix material in the monolayer is at most 16 mass %. This results in the best combination of ballistic performance and mouldability of the ballistic resistant moulded article.

It was found that in order to achieve the required mouldability the weight, or areal density, of the monolayer has to be at least 25 g/m$^2$. Preferably, the weight of the monolayer is between 30 and 200 g/m$^2$. More preferably, the weight of the monolayer is between 30 and 180 g/m$^2$. Most preferably, the weight of the monolayer is between 40 and 150 g/m$^2$.

For the manufacture of the ballistic resistant sheet according to the invention, the unidirectionally reinforcing fibers are impregnated with the matrix material for instance by applying one or more plastic films to the top, bottom or both sides of the plane of the fibers and then passing these, together with the fibers, through heated pressure rolls. Preferably, however, the fibers, after being oriented in parallel fashion in one plane, are coated with an amount of a liquid substance containing the matrix material. The advantage of this is that more rapid and better impregnation of the fibers is achieved. The liquid substance may be for example a solution, a dispersion or a melt of the plastic. If a solution or a dispersion of the plastic is used in the manufacture of the monolayer, the process also comprises evaporating the solvent or dispersant. In this way a monolayer is obtained. Subsequently at least 4 of such monolayers are stacked in such a way that the fiber direction in each monolayer is rotated with respect to the fiber direction in an adjacent monolayer. Finally the stacked monolayers are given a treatment so that they are linked or attached to one another. A suitable treatment may be pressing or laminating the stack at a temperature sufficiently high to obtain adhesion. Generally a higher temperature will give a better adhesion. The adhesion may be further increased by applying some pressure. Suitable pressure and temperature can be found by some routine experimentation. In the event of high performance polyethylene fibers such temperature may not exceed 150° C.

The ballistic resistant sheet according to the invention may suitably be piled up and compressed to form a ballistic resistant moulded article. With ballistic resistant moulded articles are meant shaped parts, comprising at least two ballistic resistant sheets according to the invention, which may be used as, for example, a panel for use in e.g. a vehicle, especially a curved panel, a hard insert e.g. for use in protective clothing and bullet resistant vests, etc. All these applications offer protection against ballistic impacts such as bullets and ballistic fragments.

The invention further relates to a ballistic resistant moulded article comprising at least two ballistic resistant sheets according to the invention. For the ballistic resistant moulded article to have a good ballistic resistance the number of ballistic resistant sheets in the article is at least 10, more preferably at least 15 and most preferably at least 20.

Generally the ballistic resistant moulded article of the invention will not be thicker than 125 mm; preferably not be thicker than 100 mm and more preferably not be thicker than 80 mm.

The ballistic resistant moulded article according to the invention may suitable be combined with a ceramic layer and/or a metal layer. Such metal and/or ceramic layer is then positioned at the side of the ballistic resistant moulded article facing the ballistic impact, i.e. as a strike face.

In the event that the ballistic resistant moulded article according to the invention is used in ballistic applications where a threat against armor piercing bullets may be encountered, the strike face preferably is a ceramic layer. In this way an article is obtained with a layered structure as follows: ceramic layer/compressed piled up ballistic resistant sheets. Optionally a metal layer may be present as an additional layer between the ceramic layer and the compressed piled up ballistic resistant sheets.

Suitable ceramic materials include e.g. alumina oxide, titanium oxide, silicium oxide, silicium carbide, silicium nitride and boron carbide. The thickness of the ceramic layer depends on the level of ballistic threat but generally varies between 2 mm and 30 mm. This composite article will be positioned preferably such that the ceramic layer faces the ballistic threat.

Suitable metals include aluminum, magnesium, titanium, copper, nickel, chromium, beryllium, iron including their alloys as e.g. steel and stainless steel and alloys of aluminum with magnesium (so-called aluminum 5000 series), and alloys of aluminum with zinc and magnesium or with zinc, magnesium and copper (so-called aluminum 7000 series).

The invention furthermore relates to a process for producing a ballistic resistant moulded article. In this process the invention the piled up ballistic resistant sheets according to the invention may suitably be compressed at a pressure of more than 16.5 MPa, in a press or compression moulding machine. Preferably, the pressure is at least 20, or at least 25 MPa since this further enhances ballistic resistance of the moulded article. The temperature during the compression is preferably between 125 and 150° C. A higher temperature has the advantage that the time of compression can be further reduced, but such higher temperature should stay at least 10°

C. below the temperature at which the mechanical properties of the fiber start to deteriorate. In the event of high performance polyethylene fibers the temperature should not exceed 150° C., that is remain below the melting range of the fibers. In a preferred embodiment, the stack preferably comprising a polyurethane matrix material is compressed for at least 60 minutes at a temperature between 125 and 135° C. After pressing at elevated temperature, before removing from the press, the stack is cooled to a temperature below 100° C., preferably below 80° C. In a preferred embodiment, the stack is cooled while still under pressure, preferably of at least 5 MPa, more preferably under the same pressure as in the preceding pressing step.

Finally the invention relates to a protective garment, such as a bullet resistant vest, comprising the ballistic resistant moulded article of the invention in the form of a hard panel.

Test Methods as Referred to in the Present Application, are as Follows:

IV: the Intrinsic Viscosity is determined according to method PTC-179 (Hercules nc. Rev. Apr. 29, 1982) at 135° C. in decalin, the dissolution time being 16 hours, with DBPC as anti-oxidant in an amount of 2 g/l solution, by extrapolating the viscosity as measured at different concentrations to zero concentration;

Tensile properties (measured at 25° C.): tensile strength (or strength), tensile modulus (or modulus) and elongation at break are defined and determined on multifilament yarns as specified in ASTM D885M, using a nominal gauge length of the fiber of 500 mm, a crosshead speed of 50%/min. On the basis of the measured stress-strain curve the modulus is determined as the gradient between 0.3 and 1% strain. For calculation of the modulus and strength, the tensile forces measured are divided by the titre, as determined by weighing 10 meters of fiber; values in GPa are calculated assuming a density of 0.97 g/cm$^3$. Tensile properties of thin films were measured in accordance with ISO 1184(H).

The modulus of the matrix material was determined according to ISO 527. The 100% modulus was determined on film strips with a length of 100 mm (free length between the clamps) and a width of 24 mm. The 100% modulus is the secant modulus measured between strains of 0% and 100%.

The invention shall now be further elucidated with the following example and comparative experiment, without being limited thereto.

Example 1

First a unidirectional monolayer was made on a drum winder. To this end a siliconised paper was attached to the drum of the drum winder. The drum had a circumference and width that were both 160 cm. A polyethylene yarn with a tenacity of 3.6 GPa and a titer of 1.92 denier per filament was wound on the drum winder with a pitch of 3.08 mm. Before being wound on the drum the yarn was wetted with a dispersion of a Styrene Isoprene Styrene block copolymer in water. By diluting the dispersion the amount of solids taken up by the yarn was adjusted to 18 wt % with respect to the amount of yarn.

All water was evaporated by heating the drum to ~65° C. In doing so a monolayer was made with a yarn areal density of 48.6 g/m$^2$ and a matrix areal density of 10.7 g/m$^2$.

Before adding the second monolayer the first monolayer was removed from the drum, turned 90° and again attached to the drum. Using the same procedure a second monolayer was adhered to the first monolayer by winding yarn on the drum. The yarns of the second layer are oriented essentially perpendicular to the yarns in the first monolayer. This procedure was repeated to add a third and fourth mono layer.

The final sheet, i.e. the anti ballistic sheet according to the invention, consisted of 4 mono layers oriented in a 0°/90°/0°/90° direction. It had an areal density (AD) of 237.4 g/m$^2$.

In total 67 of such final sheets of 40×40 cm were stacked together and pressed into an anti-ballistic panel.

The pressing conditions to obtain the anti-ballistic panel were as follows:

The stack with the 67 final sheets was placed between two platens of a standard press. The temperature of the platens was between 125-130° C. The package was retained in the press until the temperature at the center of the package was between 115-125° C. Subsequently, the pressure was increased to a compressive pressure of 30 MPa and the package was kept under this pressure for 65 min. Subsequently the package was cooled to a temperature of 60° C. at the same compressive pressure.

The areal density of the pressed panel was 15.9 kg/m$^2$. The areal density of yarn in the panel was 13 kg/m$^2$ The obtained panels were subjected to shooting test in accordance with the procedure set out in STANAG 2920. A 7.62×39 mm Mild Steel Core bullet, often also referred to as 'AK47 MSC bullet', was used. The bullet was obtained from Messrs Sellier & Belliot, Czech Republic. These tests were performed with the aim of determining a V50 and/or the energy absorbed. V50 is the speed at which 50% of the projectiles will penetrate the armored plate. The testing procedure was as follows. The first projectile was fired at the anticipated V50 speed. The actual speed was measured shortly before impact. If the projectile was stopped, a next projectile was fired at an intended speed of about 10% higher. If it perforated, the next projectile was fired at an intended speed of about 10% lower. The actual speed of impact was always measured. V50 was the average of the two highest stops and the two lowest perforations. The performance of the armor was also determined by calculating the kinetic energy of the projectile at V50 and dividing this by the AD of the plate, the so-called 'Eabs'.

The V50 of the panel was found to be 782 m/s, and the Eabs was 186 J m$^2$/kg

Comparative Experiment A

The same procedure was used as described in example 1 to make a sheet, except the yarn tenacity was 3.3 GPa and a titer of 3.3 denier per filament, the matrix content was 22% and the yarn pitch was 6.08 mm. This resulted in a sheet comprising of 4 monolayers with each monolayer having a yarn areal density of 24.3 g/m$^2$ and a matrix areal density of 6.9 g/m$^2$.

By pressing 134 sheets a panel was obtained with an areal density of 16.7 kg/m2 and a yarn AD of 13.0 kg/m2. The yarn AD being equal to the yarn AD in example 1.

The V50 of the panel was found to be 666 m/s, the Eabs was 142 J m$^2$/kg.

These results show that despite the same amount of polyethylene fiber in the panel, viz. 13 kg/m2, the panel according to the invention in Example 1 showed a significant higher Eabs.

TABLE 1

| | | Example 1 | Comp. A |
|---|---|---|---|
| tensile strength | [GPa] | 3.6 | 3.3 |
| # monolayers per sheet | [—] | 4 | 4 |

TABLE 1-continued

| | | Example 1 | Comp. A |
|---|---|---|---|
| Mass % matrix | | 18 | 22 |
| AD yarn per monolayer | [g/m2] | 48.6 | 24.3 |
| AD matrix per monolayer | [g/m2] | 10.7 | 6.9 |
| AD monolayer | [g/m2] | 59.4 | 31.2 |
| AD per sheet | [g/m2] | 237.4 | 124.9 |
| # sheets per pack | | 67 | 134 |
| AD pack | [kg/m2] | 15.9 | 16.7 |
| Yarn AD in pack | [kg/m2] | 13.0 | 13.0 |
| V50 | [m/s] | 782 | 683 |
| Eabs yarn | | 188 | 143 |

The invention claimed is:

1. A ballistic resistant sheet comprising a stack of at least 4 monolayers, each monolayer containing unidirectionally oriented reinforcing fibers with a tensile strength of between 3.5 and 4.5 GPa, and at most 20 mass % of a matrix material, wherein each monolayer in the stack has an areal density of at least 25 g/m$^2$, and wherein the reinforcing fibers in each monolayer are unidirectionally oriented in a fiber direction which is rotated with respect to the fiber direction in an adjacent monolayer, and wherein when at least one and another of the ballistic resistant sheet are formed into a pile and subjected to curved moulding conditions, a homogenous curved ballistic resistant moulded article is formed without irregular folding of the ballistic resistant sheets in the pile.

2. The ballistic resistant sheet according to claim 1, wherein the areal density of at least one monolayer in the stack is at least 40 g/m$^2$.

3. The ballistic resistant sheet according to claim 1, wherein each of the monolayers in the stack has at most 18.5 mass % of the matrix material.

4. The ballistic resistant sheet according to claim 1, wherein the unidirectionally oriented reinforcing fibres have a tensile strength of between 3.6 and 4.3 GPa.

5. The ballistic resistant sheet according to claim 1, wherein the unidirectionally oriented reinforcing fibers are drawn polyethylene fibers.

6. The ballistic resistant sheet according to claim 1 wherein the matrix material has a 100% modulus of at least 3 MPa.

7. The ballistic resistance sheet of claim 1, wherein each of the reinforcing fibers has a titer of at most 2 denier.

8. A ballistic resistant moulded article comprising at least 10 of the ballistic resistant sheets according to claim 1.

9. The ballistic resistant moulded article according to claim 8 further comprising a ceramic or metal strike face.

10. A protective garment, comprising the ballistic resistant moulded article of claim 8.

11. The protective garment of claim 10, which is a bullet resistant vest.

* * * * *